United States Patent [19]

Kondur, Jr.

[11] 4,260,271

[45] Apr. 7, 1981

[54] INKED RIBBON ADVANCEMENT MECHANISM

[75] Inventor: Nicholas Kondur, Jr., Riverton, Wyo.

[73] Assignee: C. Itoh Electronics, Los Angeles, Calif.

[21] Appl. No.: 912,087

[22] Filed: Jun. 2, 1978

[51] Int. Cl.[3] ..... B41J 33/14

[52] U.S. Cl. ..... 400/232; 400/220.1; 400/229; 400/233; 400/236.1

[58] Field of Search ..... 400/11, 124, 218, 208, 400/204, 219, 219.2, 219.5, 220, 220.1, 223, 229, 232, 233, 234, 236, 236.1, 323; 101/93.05, 93.48, 336

[56] References Cited

U.S. PATENT DOCUMENTS

| | | | |
|---|---|---|---|
| 940,814 | 11/1909 | Kuntzler | 400/219.2 |
| 1,127,931 | 2/1915 | Smith | 400/219.5 X |
| 2,514,085 | 7/1950 | Oswold | 400/11 X |
| 2,902,136 | 9/1959 | Whippo | 400/208 X |
| 2,978,090 | 4/1961 | Brandt | 400/219 |
| 3,401,783 | 9/1968 | Norwood et al. | 400/229 X |
| 3,542,183 | 11/1970 | Stiffler | 400/229 X |
| 3,677,486 | 7/1972 | Findlay | 400/220 X |
| 3,825,103 | 7/1974 | Riley | 400/236 X |
| 3,880,271 | 4/1975 | Hebron | 400/219 X |
| 3,986,594 | 10/1976 | Kondur, Jr. | 400/218 X |
| 4,004,671 | 1/1977 | Kondur, Jr. | 101/93.05 X |
| 4,062,436 | 12/1977 | Kondur, Jr. et al. | 400/124 |
| 4,070,963 | 1/1978 | Weaver | 101/93.48 X |

OTHER PUBLICATIONS

IBM Technical Disclosure Bulletin, "Ribbon Drive for Minimum use of One-Time Ribbon", Meier et al., vol. 19, No. 1, Jun. 1976, pp. 106-107.

IBM Technical Disclosure Bulletin, "Variable Pitch Ribbon Feed", Greer, vol. 20, No. 3, Aug. 1977, pp. 1072-1073.

*Primary Examiner*—Ernest T. Wright, Jr.

*Attorney, Agent, or Firm*—W. Edward Johansen

[57] ABSTRACT

The present invention is an inked ribbon advancement mechanism which is used in combination with a printer having a movable print head. The printer includes a frame and a print head mechanically coupled to the frame so that it travels laterally along the front of the frame. The inked ribbon advancement mechanism includes an apparatus for continuously advancing an increment of inked ribbon in response to the position of the print head. The apparatus includes a device for positioning the increment of inked ribbon adjacent to the print head and a slidable member which is slidably coupled to the print head in parallel juxtaposition so that the slidable member can move differentially in response to the print head. The apparatus also includes a cam for continuously displacing the slidable member in response to the movement of the print head. The print head is mechanically coupled to a plate member to which a pair of ribbon spools are rotatably coupled so that the print head and the increment of inked ribbon from the ribbon spools travel together.

5 Claims, 3 Drawing Figures

Fig. 1.
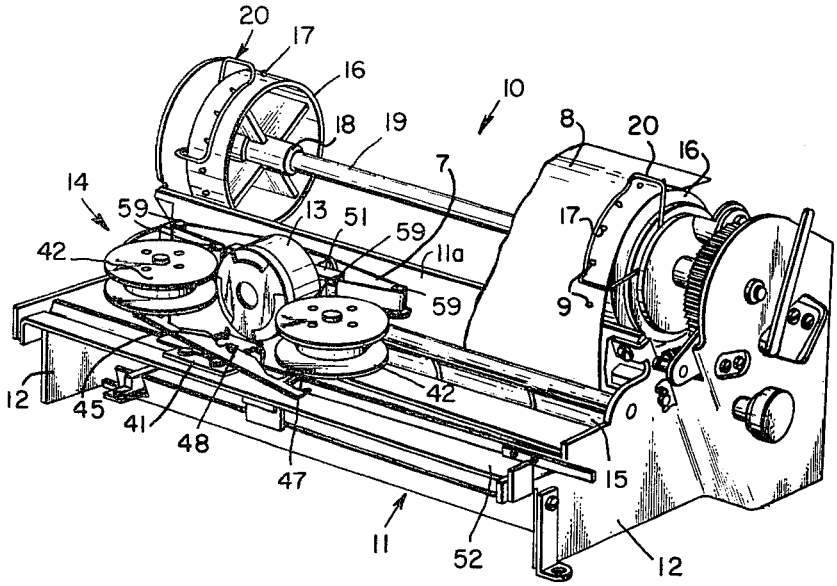
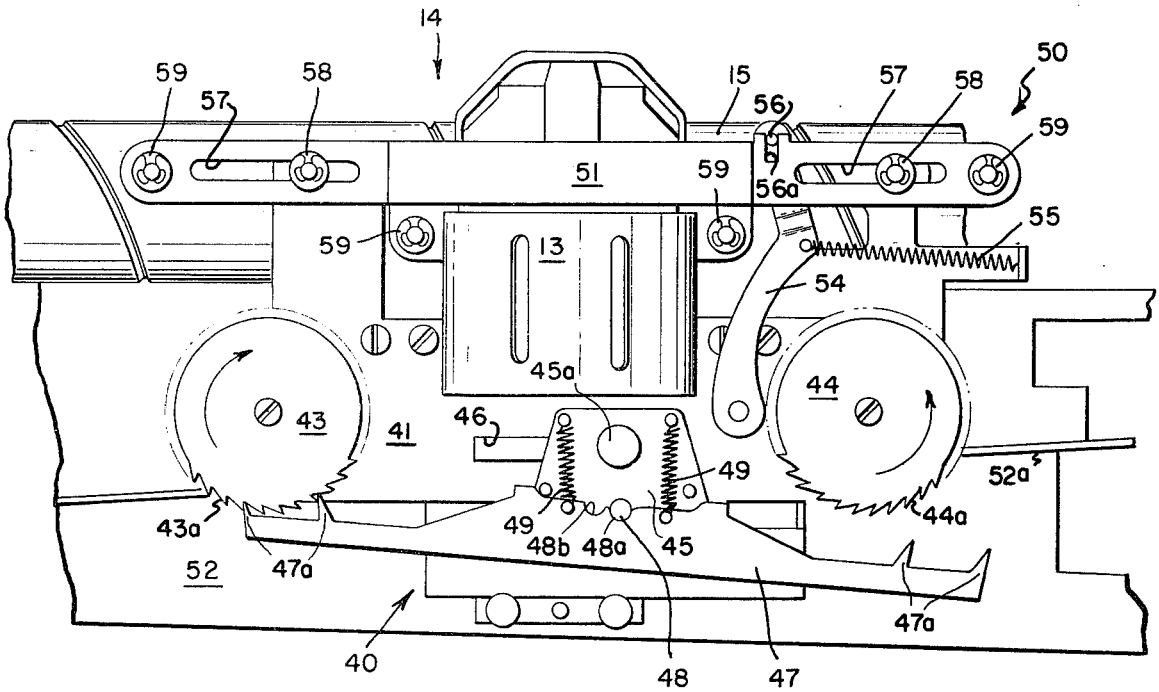
Fig. 2.

INKED RIBBON ADVANCEMENT MECHANISM

BACKGROUND OF THE INVENTION

1. Field of the Invention

The present invention relates to an inked ribbon advancement mechanism for use with a print head and more particularly to an advancement mechanism which advances an increment of inked ribbon in response to the position of the print head.

DESCRIPTION OF THE PRIOR ART

U.S. Pat. No. 3,986,594, entitled Serial Impact Calculator Printer, issued to Nicholas Kondur, Jr. on Oct. 19, 1976, teaches a serial impact printer of a type utilizing a dot matrix print head that is specifically adaptable for use in a calculator or adding machine and that is characterized by utilizing a common drive source to advance the print head across a print medium, advance the print medium between the printing operations, and selectively advance an inked ribbon between the supply ribbon spool and a takeup ribbon spool. An improved media-advancing apparatus has been devised which operates in close correlation with the print head drive member in order to provide a relatively high speed, simplified and inexpensive printer. The supply ribbon spool and the takeup ribbon spool are constructed and arranged so that they are interchangeable and permit direct drive through a spool-engaging member on the print head in order to advance the inked ribbon in direct response to the print head travel.

A ribbon spool drive member coordinates the advancement of the inked ribbon with the print head travel and it is mounted on the print head to selectively engage ratchet teeth on the ribbon spool at the end of each margin as the print head traverses the print medium. Each ribbon spool is constructed and arranged so that it exerts not only the proper tension on the inked ribbon on its passage between the print head and the print medium but also permits the selective advancement of the ribbon spool in response to engagement by the ribbon spool drive member. The ribbon spool drive member is constructed and arranged so that it is selectively engageable with one ribbon spool at a time in order to advance the inked ribbon in one direction only until it is fully wound upon one of the ribbon spools and thereafter to be reversed to selectively engage the other ribbon spool in order to cause reverse travel of the inked ribbon.

U.S. Pat. No. 3,825,103, entitled High Speed Printer Having Improved Ribbon Driving, Reversing and Tensioning Mechanism, issued to Arthur F. Riley on July 23, 1974, teaches a high-speed impact printer which has an improved ribbon driving, reversing, and tensioning mechanism that is jam-proof, of compact-simplified construction, reliable and substantially maintenance free in operation. By being compact, the drive mechanism may be centrally located at the front of the print head so as to facilitate ribbon spool and/or inked ribbon replacement. The drive mechanism, through the use of two sets of pivotally mounted, two-stage biased planetary coupling gears, effects gradual rotational engagement and disengagement of the selectively coupled driving and driven gears of the drive mechanism. This results in minimal gear wear, and produces smooth, automated reversal of the inked ribbon travel, while the inked ribbon is continuously maintained under uniform tension.

Because most dot matrix printers are of the high-speed nature it precludes an incremental movement of the inked ribbon in view of the fact that normally there would be insufficient ink (or carbon) on the inked ribbon to allow repetitive impacting of the rods of a print head against common discrete areas during each index dwell period. Accordingly, the ribbon advancement in high-speed printers cannot be accomplished simply as a by-product of the type-bar mechanical motion of conventional typewriters. Rather, the ribbon spool drive mechanism must be of a type that slowly, but continuously, advances the inked ribbon along and between the aligned arrays of the rods of the print head, and under constant tension so as to maintain the inked ribbon in alignment therewith. Ribbon reversal, of course, must also be effected automatically in any high volume printing application. In order to efficiently utilize all of the ink (or carbon) on the inked ribbon, it is also very advantageous that the entire length, of the inked ribbon be exposed to the rods of the print head impacting at some point in time during travel of the inked ribbon therepast in both directions.

U.S. Pat. No. 3,677,486, entitled Uniform Ribbon Feed Apparatus, issued to Campbell Findlay on July 18, 1972, teaches a ribbon feed apparatus having a ratcheted takeup spool engageable by a reciprocating pawl to incrementally rotate the takeup spool. A ribbon supply spool feeds an inked ribbon to the ratcheted takeup spool incrementally with each driving stroke of a pawl. In order to achieve a nearly constant speed of ribbon feed the ribbon feed apparatus combines a camming lug with the pawl which detects the changing diameter of the inked ribbon on the takeup spool and reduces the angular distance that the pawl is engaged with the ratcheted takeup spool as the ribbon diameter increases.

The inked ribbon is interposed between a print medium such as paper and a raised font on an impacting surface of one of the rods of a print head. The impact of a rod of the print head depletes the ink supply in the impacted area of the inked ribbon. Capillary action replenishes the impacted area from adjacent ribbon areas of the inked ribbon so that it can make another print of sufficient quality from the same area. To prevent reprinting on the impacted area of the inked ribbon used by a previous print the inked ribbon is moved before the next print impact is undertaken. In determining the distance the inked ribbon should move between the impacts of the rods of the print head one must consider the sufficiency of the reservoir of ink remaining to replenish the depleted area of the inked ribbon. Printing in close succession on the same area of the inked ribbon either delays the replenishment of ink in the impacted portion of the inked ribbon or inhibits it altogether. However, moving the inked ribbon for relatively great distances at high speed between prints is wasteful and also presents timing and stress difficulties in a high print rate machine.

It would be more convenient to move an increment of inked ribbon with the print head across the print line, but the problem of excessive overprinting a portion thereof must be overcome.

SUMMARY OF THE INVENTION

In view of the foregoing factors and conditions characteristic of the prior art it is an object of the present invention to provide for use with a print head an improved and simplified mechanism for continuously advancing an increment of inked ribbon in response to the position of the print head.

It is another object of the present invention to provide a mechanism for continuously advancing an increment of inked ribbon in order to prevent excessive overprinting from occurring on a portion of the inked ribbon.

It is still another object of the present invention to provide a print head and an inked ribbon advancement mechanism that are mechanically coupled together so that they move together across the printed line.

It is yet another object of the present invention to provide a mechanism for advancing an increment of inked ribbon which also provides visibility of the print line as it is being printed.

In accordance with an embodiment of the present invention an inked ribbon advancement mechanism which is used in combination with a printer having a movable print head is described. The printer includes a frame and a print head mechanically coupled to the frame so that it travels laterally along the front of the frame. The inked ribbon advancement mechanism includes an apparatus for continuously advancing an increment of inked ribbon in response to the position of the print head. The apparatus includes a device for positioning the increment of inked ribbon adjacent to the print head and a slidable member which is slidably coupled to the print head in parallel juxtaposition so that the slidable member can move differentially in response to the print head. The apparatus also includes a cam for continuously displacing the slidable member in response to the movement of the print head. The print head is mechanically coupled to a plate member to which a pair of ribbon spools are rotatably coupled so that the print head and the increment of inked ribbon from the ribbon spool travel together.

The features of the present invention which are believed to be novel are set forth with particularity in the appended claims.

Other objects and many of the attendant advantages of this invention will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective view of a printer which includes a frame, a print head and a platen for use in combination with an inked ribbon advancement mechanism that has been constructed in accordance with the principles of the present invention.

FIG. 2 is a top plan view of an inked ribbon advance and reverse mechanism in combination with the inked ribbon advancement mechanism of the printer of FIG. 1.

DESCRIPTION OF THE PREFERRED EMBODIMENT

Figure 3:
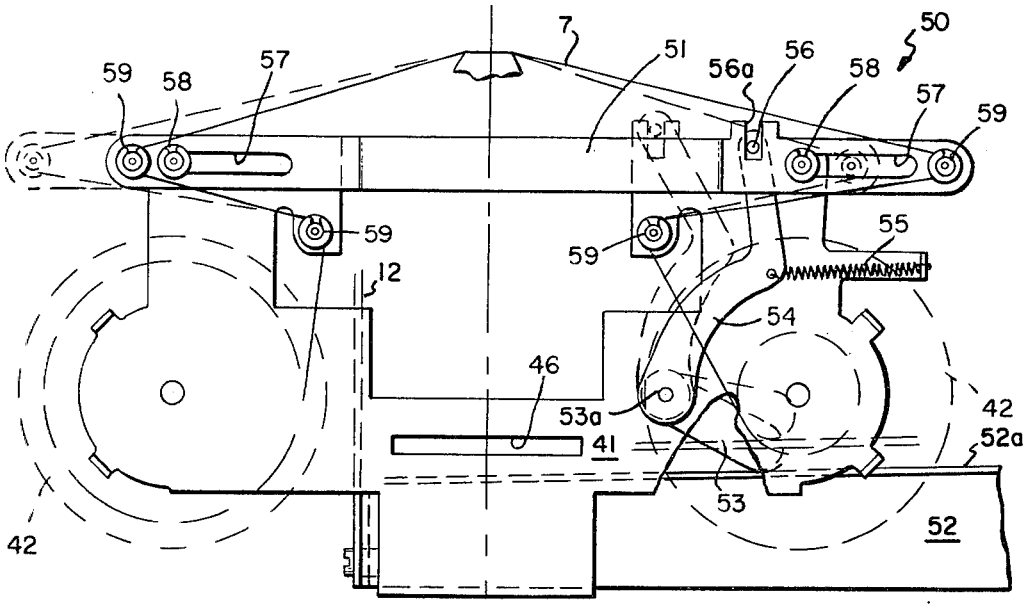
FIG. 3 is a top plan view of the inked ribbon advancement mechanism of the printer of FIG. 1 wherein the inked ribbon advance and reverse mechanism has been removed in order to show how the cam and slidable member interact to provide continuous movement of the inked ribbon in response to the movement of the print head.

In order to best understand the present invention it is first necessary to read the following description of a printer which is to be used in combination with the present invention and also to refer to the figures in the accompanying drawing. Referring to FIG. 1*a* Printer 10 includes a frame 11 having a platen 11*a*, a pair of side plates 12 and a print head 13 which is adapted to travel laterally across the front of the frame 11. The print head 13 is of a type which is generally taught in U.S. Pat. No. 4,004,671, entitled Wire Matrix Print Head, issued to Nicholas Kondur, Jr. on Jan. 25, 1977. Other U.S. Patents that teach similar print heads include: No. 4,070,963, No. 3,986,594, and No. 4,062,436. The printer 10 also includes an inking apparatus 14 which is mechanically coupled to the print head 13 in order to provide ink for printing onto a print medium 8 and a timing shaft 15 which is rotatably coupled to the frame 11 between the pair of side plates 12 and which is mechanically coupled to the print head 13 and the inking apparatus 14 to drive them in concert across the front of the frame 11. The print medium 8 may be paper with sprocket holes 9 spaced a standardized distance apart along its borders. The printer 10 further includes a pair of sprockets 16 which are disc-shaped members. Each sprocket 16 has a plurality of pins 17 which are disposed on its cylindrical sidewall and are spaced apart the same distance as are the sprocket holes 9 of the print medium 8 and also has a disc-shaped hub 18. The printer 10 still further includes a sprocket shaft 19 which is rotatably coupled to the frame 11 between the pair of side plates 12 and which mechanically couples each of the sprockets 16 adjacent to one of the side plates 12 and a media guide 20 including a pair of integral members each of which is rotatably coupled to the disc-shaped hub 18 of one of the sprockets 16 so that the print medium 8 is disposed between one of the integral members of the media guide 20 and the cylindrical sidewall of the sprocket 16 and is engaged by the pins 17 thereof through its sprocket holes 9.

Referring to FIG. 1 the inking apparatus 14 is similar to the one taught in U.S. Pat. No. 3,986,594, entitled Serial Impact Calculator Printer, issued to Nicholas Kondur, Jr. on Oct. 19, 1976.

Referring now to FIG. 2 in conjunction with FIG. 1 the inking apparatus 14 includes an inked ribbon advance and reverse mechanism 40 which is mounted on a plate member 41 and which travels in concert with the print head 13 across the front of the frame 11 of the printer 10. The inked ribbon advance and reverse mechanism 40 includes a pair of ribbon spools 42 which are rotatably coupled to the plate member 41 so that the ribbon spools 42 can rotate bidirectionally in order to dispense an increment of inked ribbon 7. A first ratchet wheel 43 has a plurality of teeth 43*a*, which are disposed in a particular direction, and is mechanically coupled to one of the ribbon spools 42 in axial alignment therewith. A second ratchet wheel 44 has a plurality of teeth 44*a*, which are disposed in an opposite direction to the teeth 43*a* of the first ratchet wheel 43, and is mechanically coupled to the other ribbon spool 43 in axial alignment therewith. The inked ribbon advance and reverse mechanism 40 also includes a sliding member 45 which is slidably coupled by a rivet 45*a*, which is fixedly coupled to the sliding member 45, within a slot 46 in the plate member 41. The plate member 41 and the sliding member 45 travel in concert laterally across the frame 11 until the side of the sliding member 45 contacts the side 12 of the frame 11 which impedes its motion while allowing a differential motion between the plate member 41 and the sliding member 45. The inked ribbon advance and reverse mechanism 40 further includes an improved pawl 47 which has a plurality of teeth 47*a*, which increase in height from each end, disposed at each end and which is connected to the sliding member 45 by a pivot pin 48 which is mechanically coupled to the sliding member 45 within one of a pair of shallow grooves 48*a* and 48*b* in the pawl 47 at its center. Among the advantages of having a plurality of teeth 47*a* is that the angle of contact between the pawl 47 and the ratchet wheel 43 or 44 is reduced. This reduction in the angle of contact will cause a reduction in the force upon the improved pawl 47 because the force which is required to rotate the ribbon spool 42 is equal to the torque applied to the ribbon spool 42 by the inked ribbon 7 divided by the distance from the center line of the ribbon spool 42 to a line along the improved pawl 47 which intersects the center line at an angle of ninety degrees (90°). Another advantage of the plurality of teeth 47*a* on the improved pawl 47 is that they provide more rotational advancement of the ribbon spools 42 thereby providing a larger increment of inked ribbon for each advancement. This larger increment of inked ribbon 7 is important in an eighty column line printer. The teeth 47*a* increase in height as they move toward the center of the improved pawl 47 because each successive tooth 47*a* must be taller than the previous tooth 47*a* in order to engage the ratchet wheel 43 and 44.

The inking apparatus 14 of U.S. Pat. No. 3,986,594 is stationary and the movable print head moves the improved pawl 47 into position while moving in one direction and causes the improved pawl 47 to move the ratchet wheel 43 or 44. In the preferred embodiment of the present invention the inking apparatus 14 travels in concert with the print head 13, which is mounted on the plate member 41. However, it is not necessary to have the print head 13 and the inking apparatus 14 travel in concert in order to provide a plurality of teeth 47*a* at each end of the improved pawl 47 rather than a single tooth 47*a* at each end thereof. When the print head 13 and the inking apparatus 14 do not move in concert the operation of the inked ribbon advance and reverse mechanism 40 is similar to that described above in U.S. Pat. No. 3,986,594 and has the pivot pin 48 mounted on the plate member 41. However, as in the preferred embodiment of the present invention, when they do move in concert the operation of the inked ribbon advance and reverse mechanism 40 requires the use of the sliding member 45 with the pivot pin 48 mounted thereon rather than on the plate member 41. The sliding member 45 is slidably coupled to the plate member 41 on which the print head 13 is mounted so that the improved pawl 47 may move differentially with respect to the ribbon spools 42. The inked ribbon advance and reverse mechanism 40 further includes a pair of springs 49 which spring couple the improved pawl 47 to the plate member 41 through the pivot pin 48 which is rigidly affixed to the sliding member 45.

The inking apparatus 14 also includes an inked ribbon advancement mechanism 50 for advancing the increment of inked ribbon 7 continuously in response to the movement of the print head 13 so that no portion of the increment of inked ribbon 7 is used more than twice in any one printing cycle thereof. Referring still to FIG. 2 the inked ribbon advancement mechanism 50 includes a slidable member 51 and a cam member 52. The slidable member 51 is adapted to position the increment of inked ribbon 7 in front of the print head 13 adjacent thereto and is slideably coupled to the print head 13 so that it can move in juxtaposition direction thereby moving differentially to the print head 13 and in response thereto. The cam member 52 is a flat elongated trapezoid one of the non-parallel sides of which has a flat surface 52*a*.

Referring now to FIG. 3 the inked ribbon advancement mechanism 50 also includes the cam member 52 which is disposed between the side plates 12, a cam coupling member 53 which is adapted to slidably travel along the flat surface 52*a* of the cam member 52 and a pivot arm 54 which is fixedly coupled to the cam coupling member 53 at a point 53*a* and which is pivotally coupled to the plate member 41. A spring 55 resiliently couples the pivot arm 54 to the plate member 41. The pivot arm 54 has a pin 56 which is adapted to slidably and pivotally couple the pivot arm 54 to a slot 56*a* in the slidable member 51. The slidable member 51 has a pair of slots 57 which are slidably coupled to a pair of pins 58 so that the slidable member 51 may slide in juxtaposition direction to the print head 13 on the pair of pins 58 which are fixedly coupled to the plate member 41. The inked ribbon advancement mechanism 50 further includes a set of four roller-pins 59, two of which are fixedly coupled to the slidable member 51 and two of which are fixedly coupled to the plate member 41. The increment of inked ribbon 7 is disposed contiguous to the four roller-pins 59 so that the increment of inked ribbon 7 as it leaves one of the inked ribbon spools 42 loops around the first of the four roller-pins 59, which is fixedly coupled to the plate member 41, as is the fourth of the four roller-pins 59, then it loops around the second of the four roller-pins 59, which is fixedly coupled to the slidable member 51 as is the third of the four roller-pins 59, and finally it passes across the print head 13 and looping itself around the third and fourth of the four roller-pins 59 as it enters the other inked ribbon spool 42. As the slidable member 51 slides the second and third roller-pins 59, it moves the portion of the increment of inked ribbon 7 between them across the print head 13. The portions of the increment of inked ribbon 7 between the first ribbon spool 42 and the first roller-pin 59 and between the second ribbon spool 42 and the fourth roller-pin 59 remain stationary with respect to the plate member 41.

Referring still to FIG. 3 during the printing operation of the printer 10 the plate member 41 moves in a left to right direction across the printer 10 and then returns to its at rest position. During this movement, the cam coupling member 53 is driven in a counter-clockwise direction as viewed from above, by the flat surface 52*a* of the cam member 52. This occurs since the cam member 52 does not move with the plate member 41. The pivot arm 54 is rotatively coupled to the plate member 41 and moves therewith. When the cam coupling member 53 rotates, it rotates the pivot arm 54 in the same direction and with the same angular displacement. The spring 55 attaches the pivot arm 54 to the plate member 41 and biases it in a clockwise direction so that it maintains contact between the cam coupling member 53 and the flat surface 52*a* of the cam member 52 through the pivot arm 54. The slidable member 51 is moved from right to left and left to right by the pin 56 in the pivot arm 54 through the slot 56*a* in the slidable member 51 as the pivot arm 54 is rotated by the cam coupling member 53 interacting with the flat surface 52*a* of the cam member 52. The slidable member 51 is constrained by the slots 57 and the pair of pins 58 so that its motion is linear even though the pivot arm 54 describes an arc in its motion. The roller-pins 59 are attached to the slidable member 51 so that the roller-pins 59 may rotate freely when they are driven by the inked ribbon 7 which is in partial circumferential engagement with the roller-pins 59. The displacement distance as a result of the interaction of the print head 13 with the slidable member 51 is equal to twice the displacement distance of the slidable member 51 due to the fact that the roller-pins 59 act as the centers of compound pulleys with a multiplication factor of two. A point on the inked ribbon 7 will move from its start position to its end position upon the full left to right movement of the plate member 41 and will move from its end position to its start position upon the return to the rest position of the plate member 41. The specific configuration embodied in this printer 10 has been selected to minimize, to the extent that the constraints of the inked ribbon advancement mechanism 40 will permit, the occurrence of slack in the inked ribbon 7 as a result of the changing lengths of the inked ribbon 7 on each side of the center line of the plate member 41 as the slidable member 51 is moved from right to left. According to calculation and by observation of the operating inked ribbon advancement mechanism 50 the slack is approximately 0.010 inches, which is an acceptable amount. If no provision was made to move the inked ribbon 7 with respect to the print head 13 during the printing operation, then overprints would occur on a small area of the inked ribbon 7 (approximately 0.015"×0.115") which would result in a rapid depletion of the ink contained in the inked ribbon 7 and would further result in irregularly inked printed characters, lightly inked printed characters or, in the worst case, insufficiently inked characters to the extent of illegibility. This design allows a larger area of the inked ribbon 7, an area of approximately 1.25"×0.115", to be utilized during printing.

From the foregoing it can be seen that an inked ribbon advancement mechanism has been described. Accordingly, it is intended that the foregoing disclosure and showing made in the drawing shall be considered only as illustrations of the present invention. Furthermore it should be noted that the sketches are not drawn to scale and that distances of and between the figures are not to be considered significant. The invention will be set forth with particularity in the appended claims.

What is claimed is:

1. An inked ribbon advancement mechanism which is used in combination with a printer having a movable print head, said inked ribbon advancement mechanism comprising advancing means for continuously advancing an increment of an inked ribbon in response to the position of the movable print head, said advancing means moving the increment of inked ribbon proportionally to the movement and the direction of the movable print head so that the increment of inked ribbon is used twice as the movable print head travels forward and backward.

2. An inked ribbon advancement mechanism according to claim 1 wherein said advancing means comprises:

a. positioning means for positioning the increment of inked ribbon adjacent to the movable print head; and b. a slidable member which is slidably coupled to the movable print head in parallel, juxtaposition so that said slidable member moves differentially to the movable print head in response thereto.

3. An inked ribbon advancement mechanism according to claim 2 wherein said advancing means also comprises:

a. cam means for continuously displacing said slidable member in response to the movement of the movable print head.

4. An inked ribbon advancement mechanism according to claim 3 wherein the printer includes a frame and the movable print head is mechanically coupled to an inked ribbon advance and reverse mechanism which includes:

a. a plate member upon which the movable print head is mounted and which travels across the front of the frame;

b. a pair of ribbon spools, which are disposed on the surface of the plate member and which are rotatably coupled thereto, the pair of ribbon spools receiving the inked ribbon and also bidirectionally rotatable in order to dispense the increment of inked ribbon;

c. a pair of ratchet wheels, each having teeth disposed in opposite directions, each of which is mechanically coupled to one of the pair of ribbon spools in axial alignment therewith;

d. an elongated member having a pair of ends, each end having a plurality of teeth which are disposed along the surface that mechanically engages one of the teeth of the pair of ratchet wheels;

e. a sliding member which is mechanically coupled to the plate member so that the sliding member can move in a parallel, juxtaposition direction with respect to the plate member thereby providing differential motion between the pair of ribbon spools and the elongated member;

f. a pin mechanically coupled to the sliding member, the pin pivotally coupling the elongated member to the sliding member; and g. a pair of springs mechanically coupling the elongated member to said sliding member, wherein said cam means comprises:

a. a substantially trapezoidal member which has a cam surface and which is mechanically coupled to the frame, said cam surface being disposed so that the movable print head travels in a juxtaposition direction; and b. a pivot arm pivotally coupled to said slidable member and mechanically coupled to said trapezoidal member so that said pivot arm slides along said cam surface moving said slidable member as the movable print head moves in response thereto.

5. An inked ribbon advancement mechanism according to claim 4 wherein the geometry of the slidable member has been chosen in order to minimize looping of the increment of inked ribbon.

* * * * *